US006243533B1

(12) United States Patent
Stern

(10) Patent No.: US 6,243,533 B1
(45) Date of Patent: Jun. 5, 2001

(54) MULTIPLE HAIR SETTING ROLLER HEATING AND FACIAL STEAMING APPARATUS

(75) Inventor: Paule Stern, San Diego, CA (US)

(73) Assignee: Madison Star LLC, San Diego, CA (US)

( * ) Notice: Subject to any disclaimer, the term of this patent is extended or adjusted under 35 U.S.C. 154(b) by 0 days.

(21) Appl. No.: 09/633,443

(22) Filed: Aug. 7, 2000

Related U.S. Application Data

(63) Continuation of application No. 09/062,539, filed on Apr. 17, 1998, now Pat. No. 6,101,317.
(60) Provisional application No. 60/045,004, filed on Apr. 25, 1997.

(51) Int. Cl.[7] ..... A61H 33/12; A45D 1/04
(52) U.S. Cl. ..... 392/405; 219/222; 132/229
(58) Field of Search ..... 392/386, 394, 392/403, 404, 405, 406; 219/222; 132/227, 228, 229, 230

(56) References Cited

U.S. PATENT DOCUMENTS

| | | | | |
|---|---|---|---|---|
| 3,152,240 | * | 10/1964 | Scott | 392/403 |
| 3,351,737 | * | 11/1967 | Katzman et al. | 392/403 |
| 3,493,722 | * | 2/1970 | Popeil | 392/403 |
| 3,646,316 | * | 2/1972 | Volosin et al. | 219/222 |
| 3,666,915 | * | 5/1972 | De Napoli | 219/222 |
| 3,858,029 | * | 12/1974 | Walter | 219/222 |
| 4,399,349 | * | 8/1983 | Deming et al. | 392/403 |
| 4,516,011 | * | 5/1985 | Jeffress et al. | 219/222 |
| 5,309,930 | * | 5/1994 | Presser | 132/272 |
| 5,355,591 | * | 10/1994 | Caruso | 392/394 |
| 5,761,378 | * | 6/1998 | Boyle et al. | 392/403 |
| 6,101,317 | * | 8/2000 | Stern | 392/394 |

* cited by examiner

*Primary Examiner*—Sang Paik
(74) *Attorney, Agent, or Firm*—Flanagan & Flanagan; John R. Flanagan; John K. Flanagan

(57) ABSTRACT

A multiple hair setting roller heating and facial steaming apparatus includes a housing, an enclosure, a heating module, a heating element, at least one outlet and a hood. The housing defines a receptacle for receiving and holding a quantity of a desired liquid and defines a platform. The enclosure has an open bottom and defines an interior chamber. The enclosure is mounted to and extends downwardly from the platform of the housing and into the receptacle of the housing below the surface of the quantity of liquid in the receptacle such that air is captured in the interior chamber of the enclosure. The heating module is mounted to the platform of the housing and extends downwardly therefrom within the interior chamber of the enclosure. The heating module has a passage and an inlet extending below the open bottom of the enclosure so as to provide direct flow communication of liquid from the receptacle of the housing to the passage of the heating module bypassing the interior chamber of the enclosure. The heating element is mounted in the passage of the heating module and is operable to convert the liquid to vapor therein. The outlet extends from the platform of the housing so as to support a hair setting roller and to provide flow communication of the vapor from the passage of the heating module to above the platform of the housing for heating the roller with the vapor and for use as a source of steam above the platform. The hood is in the form of a tubular body which interfits with the housing and receives the source of steam and defines an open portion conforming to a chin and face of a woman.

10 Claims, 4 Drawing Sheets

FIG. 1
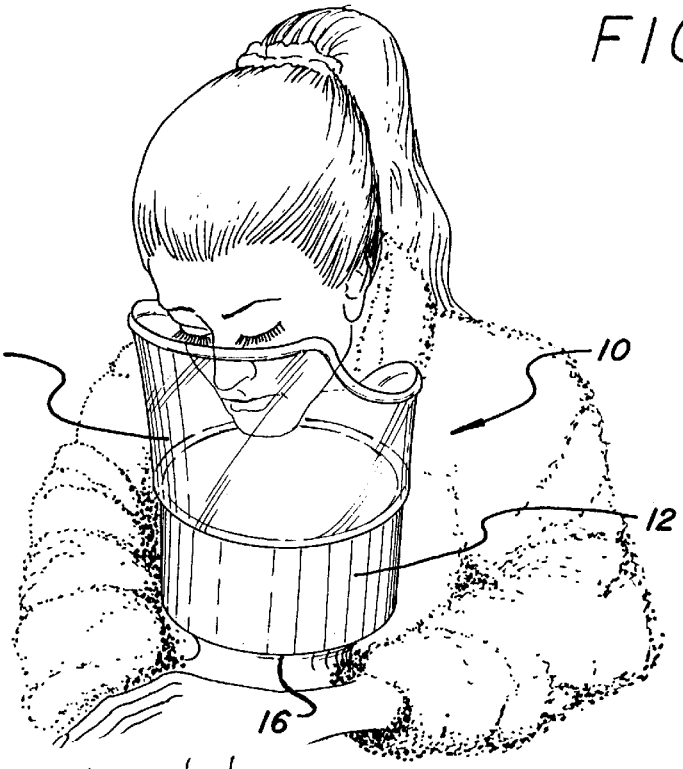
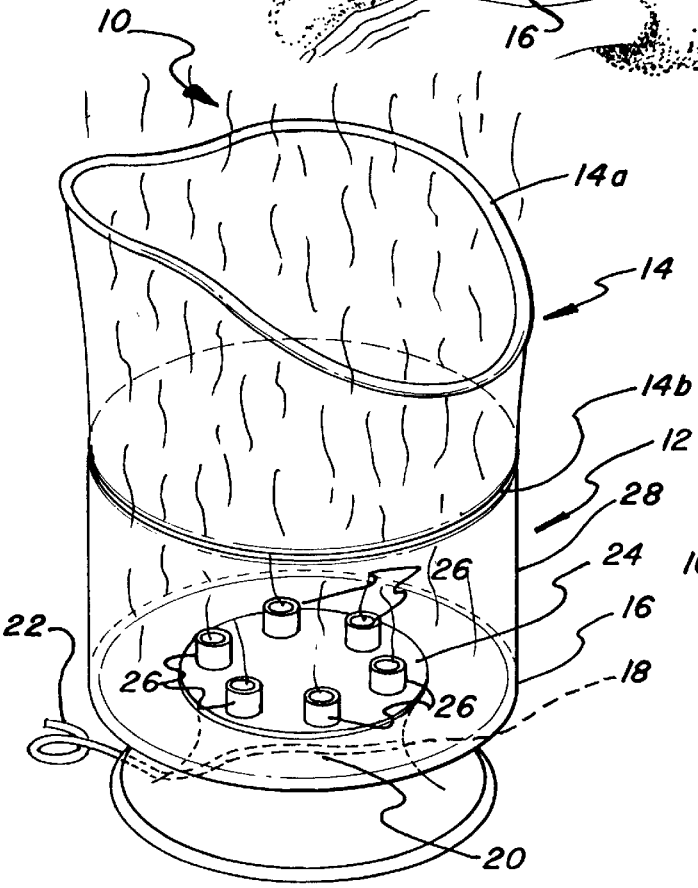
FIG. 2
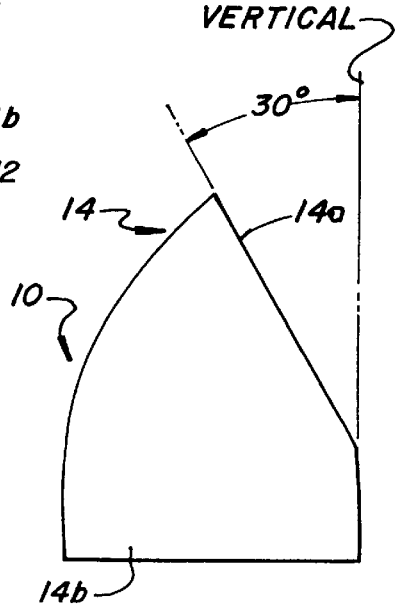
FIG. 3

FIG. 6
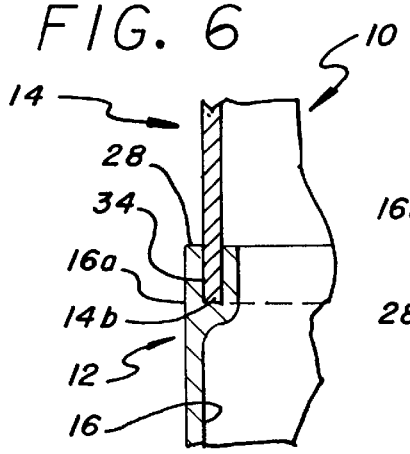
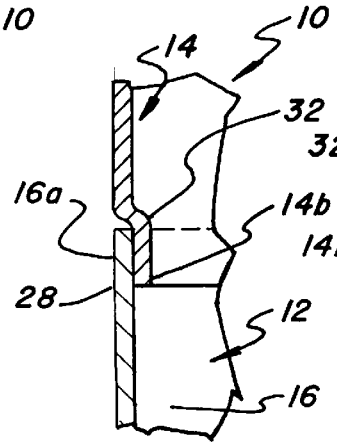
FIG. 4
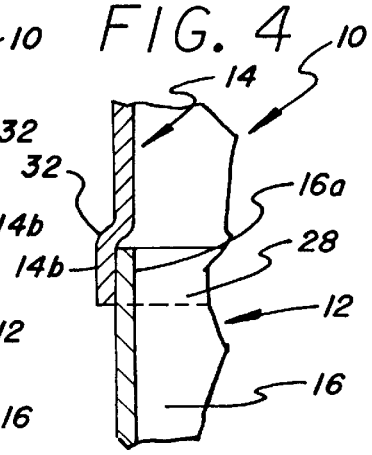
FIG. 5
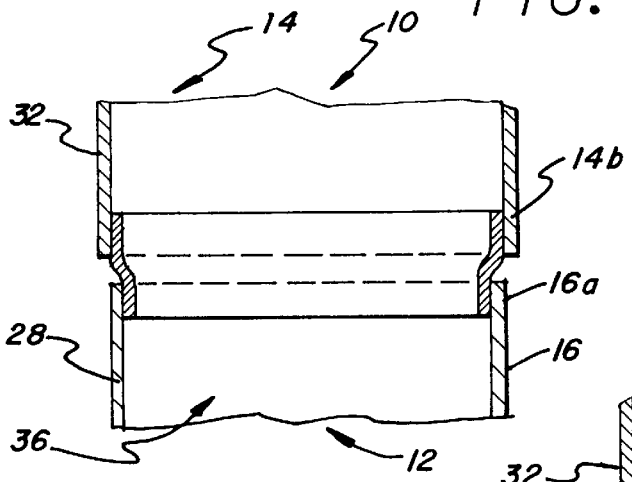
FIG. 8
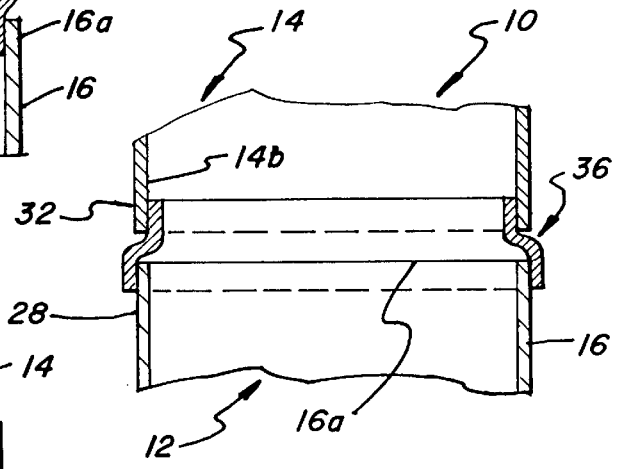
FIG. 7
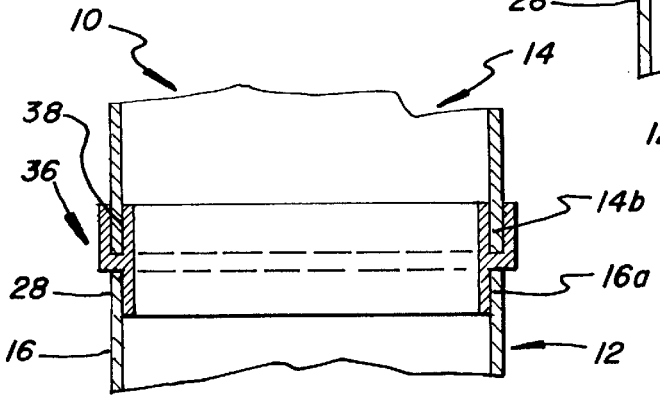
FIG. 9

MULTIPLE HAIR SETTING ROLLER HEATING AND FACIAL STEAMING APPARATUS

This application is a continuation of application Ser. No. 09/062,539 filed Apr. 17, 1998 now U.S. Pat. No. 6,101,317.

This application claims the benefit of provisional application No. 60/045,004, filed Apr. 25, 1997.

BACKGROUND OF THE INVENTION

1. Field of the Invention

The present invention generally relates to hair styling and skin care and, more particularly, is concerned with a multiple hair setting roller heating and facial steaming-apparatus.

2. Description of the Prior Art

Women have traditionally patronized beauty parlors and the like to utilize the various hair and skin beauty treatments which these operations provide, such as hair styling, sauna baths, facial steaming treatments, mineral water treatments, and aromatherapy. However, with ever-increasing demands placed on their time and money, many working women are unable to frequent such establishments to take advantage of these traditional beauty treatment offerings.

Products have been introduced into the marketplace from time to time for use by women at home in an attempt to respond to beauty care needs of working women. For example, devices exist that are designed to heat one or more hair setting rollers commonly used by women to form waves and/or curls in styling their hair. Representative examples of such devices are disclosed in U.S. Pat. No. 3,610,878 to Thomas et al., U.S. Pat. No. 3,646,316 to Volosin et al., U.S. Pat. No. 3,858,029 to Walter, U.S. Pat. Nos. 4,572,221 and 5,482,060 to Barradas and U.S. Pat. Nos. 4,603,706, 4,627,452 and 5,255,694 to Caruso. For facial steaming treatments women have heretofore had to prepare and apply steamy hot moist towels to their faces. No product has appeared in the marketplace which provides a comprehensive solution in terms of saving time and money in providing a variety of beauty treatments for women.

Consequently, a need remains for an apparatus which has the capability to address skin care and hair styling requirements of women.

SUMMARY OF THE INVENTION

The present invention provides a multiple hair setting roller heating and facial steaming apparatus designed to satisfy the aforementioned needs. The apparatus of the present invention incorporates features which permit use as a multiple hair setting roller heater or as a facial steamer and provides for quick and easy conversion between these separate uses.

Accordingly, the present invention is directed to a multiple hair setting roller heating apparatus which comprises: (a) a housing having a lower portion and an upper portion, the lower portion defining a receptacle for receiving and holding a quantity of a desired liquid, the upper portion defining a platform above the receptacle; (b) a heating module having an upper end and a lower end and being mounted in the housing below the platform thereof and extending downwardly into the receptacle thereof, the heating module further having a passage extending between the upper and lower ends thereof so as to provide flow communication of liquid from the receptacle of the housing to the platform thereof; (c) a heating element mounted in the passage of the heating module and being operable to convert the liquid to vapor therein; and (d) at least two outlets extending from the platform of the upper portion of the housing, each of the outlets being adapted to support a hair setting roller and provide flow communication of the vapor from the passage of the heating module to above the platform of the housing for heating the hair setting rollers with the vapor. Each of the outlets is a pick having a body adapted to support a hair setting roller and defining at least one vent for passage of the vapor therethrough. In one form, the body of the pick is tubular shaped. The heating elements is preferably a type known as a positive temperature co-efficient (PTC) heater.

The present invention is further directed to a multiple hair setting roller heating apparatus which comprises: (a) a housing having a lower portion and an upper portion, the lower portion defining a receptacle for receiving and holding a quantity of a desired liquid, the upper portion being mounted on the lower portion and defining a platform; (b) an enclosure having an open bottom and defining an interior chamber, the enclosure being mounted to and extending downwardly from the platform of the upper portion of the housing and into the receptacle of the lower portion of the housing below the surface of the quantity of liquid in the receptacle such that air is captured in the interior chamber of the enclosure so as to prevent entry of the liquid into the interior chamber; (c) a first heating module having an upper end and a lower end and being disposed in the interior chamber of the enclosure, the first heating module mounted in the housing below the platform thereof and extending downwardly from the upper end to the lower end of the first heating module, the first heating module further having a passage defined therein and extending between the upper and lower ends and an inlet defined in the lower end and extending below the open bottom of the enclosure so as to provide direct flow communication of liquid from the receptacle of the lower portion of the housing to the passage of the first heating module bypassing the interior chamber of the enclosure; (d) a first heating element mounted in the passage of the first heating module and being operable to convert the liquid to vapor therein; and (e) a first outlet extending from the platform of the upper portion of the housing, the first outlet being adapted to support a hair setting roller and provide flow communication of the vapor from the passage of the first heating module to above the platform of the upper portion of the housing for heating the roller with the vapor. A plurality of the first outlets are provided in flow communication with the first heating module. Each outlet is a pick having a body adapted to support a hair setting roller and defining at least one vent for passage of the vapor therethrough.

The apparatus further comprises a second heating module, a second heating element and a second outlet. The second heating module is separate and spaced apart from the first heating module and has an upper end and a lower end. The second heating module is disposed in the interior chamber of the enclosure and mounted in the housing below the platform thereof and extends downwardly from the upper end to the lower end of the second heating module. The second heating module further has a passage defined therein extending between the upper and lower ends and an inlet defined in the lower end extending below the open bottom of the enclosure so as to provide direct flow communication of liquid from the receptacle of the lower portion of the housing to the passage of the second heating module bypassing the interior chamber of the enclosure. The second heating element is mounted in the passage of the second heating module and is operable to convert the liquid to vapor therein.

The second outlet extends from the platform of the upper portion of the housing. The second outlet is adapted to support a hair setting roller and provide flow communication of the vapor from the passage of the second heating module to above the platform of the upper portion of the housing for heating the roller with the vapor. The apparatus further comprises pluralities of the first and second outlets provided in flow communication respectively with the first and second heating modules. The first and second heating elements are preferably a type known as a positive temperature co-efficient (PTC) heater. The provision of at least two outlets communicating with each PTC heater at least doubles the productivity of each heating module.

Also, the present invention is directed to a facial steaming apparatus which comprises: (a) a housing having a lower portion and an upper portion, the lower portion defining a receptacle for receiving and holding a quantity of a desired liquid, the upper portion being mounted on the lower portion and defining a platform; (b) a heating mechanism mounted in the housing and extending downwardly from the platform into the receptacle and being operable to convert the liquid to vapor; (c) at least one outlet extending from the platform of the upper portion of the housing and adapted to support a hair setting roller above the platform, the outlet defining at least one vent for passage of the vapor therethrough so as to provide flow communication of the vapor from below the platform for use as a source of steam above the platform; and (d) a hood in the form of a tubular body having opposite upper and lower open ends and a continuous side wall defining an open portion conforming to a chin and face of a woman, the lower open end interfitting with the upper portion of the housing and receiving the source of steam. The hood preferably removably interfits on the upper portion of the housing.

The facial steaming apparatus further comprises an electrical cord connected to the heating element for supplying electrical power thereto. The hood further has a continuous ledge extending interiorly from the lower open end of the hood. The apparatus may also comprise a removable cover seated on the continuous ledge of the hood and disposed over the platform of the upper portion of the housing so as to enclose the outlet. The side wall of the hood flares outwardly and is inclined generally at an angle of from zero to sixty degrees from a vertical and preferably at an angle of from fifteen to forty-five degrees from a vertical. The lower open end of the hood has a bottom rim and the upper portion of the housing has a top rim. These bottom and top rims may have a variety of mating relationships. The apparatus may also comprise an annular adapter for providing an interface between the top and bottom rims of the housing and hood.

Further, the present invention is directed to the above-described apparatus convertible between multiple hair setting roller heating and facial steaming uses. To convert the apparatus from facial steaming use to hair setting roller heating use merely involves removing the hood from the housing of the apparatus.

These and other features and advantages of the present invention will become apparent to those skilled in the art upon a reading of the following detailed description when taken in conjunction with the drawings wherein there is shown and described illustrative embodiment(s) of the invention.

BRIEF DESCRIPTION OF THE DRAWINGS

In the following detailed description, reference will be made to the attached drawings in which:

FIG. 1 is a perspective view of a woman using a multiple hair setting roller heating and facial steaming apparatus of the present invention as a facial sauna or steamer.

FIG. 2 is an enlarged perspective view of the apparatus of FIG. 1.

FIG. 3 is a diagrammatic side elevational view of a hood of the apparatus of FIGS. 1 and 2.

FIGS. 4 to 6 are enlarged fragmentary sectional views showing different mating relationships between the hood and an upper portion of a housing of the apparatus.

FIGS. 7 to 9 are fragmentary sectional views showing different forms of an optional annular adapter providing an interface between the hood and the housing of the apparatus.

DETAILED DESCRIPTION OF THE INVENTION

Figures 10, 14, 15:
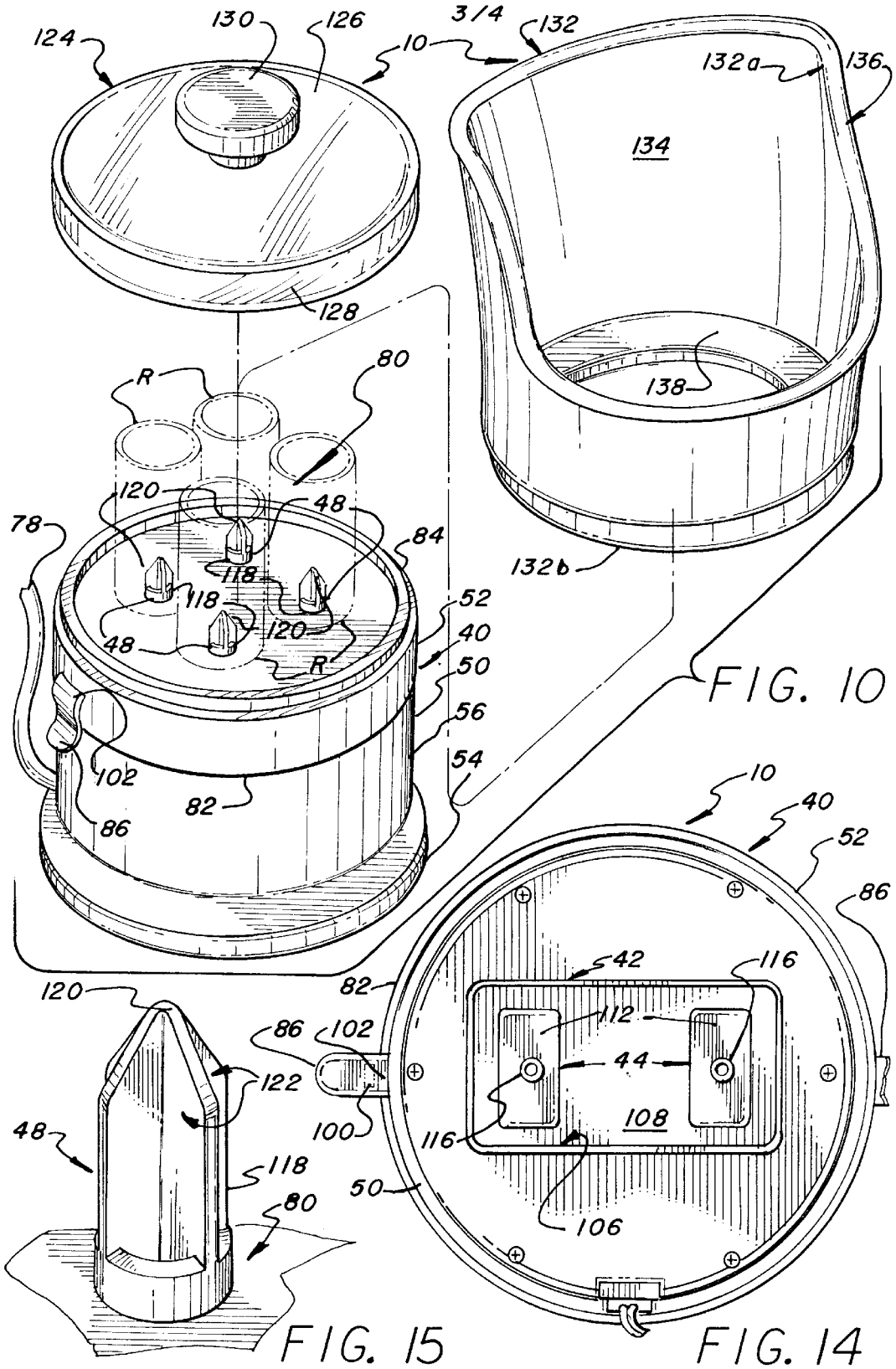
FIG. 10 is a perspective view of a preferred embodiment of the multiple hair setting roller heating and facial steaming apparatus of the present invention.
FIG. 14 is a cross-sectional view on a reduced scale of the apparatus taken along line 14—14 of FIG. 11.
FIG. 15 is an enlarged view of one of the hollow picks of the apparatus seen in FIG. 10.
Figure 11:
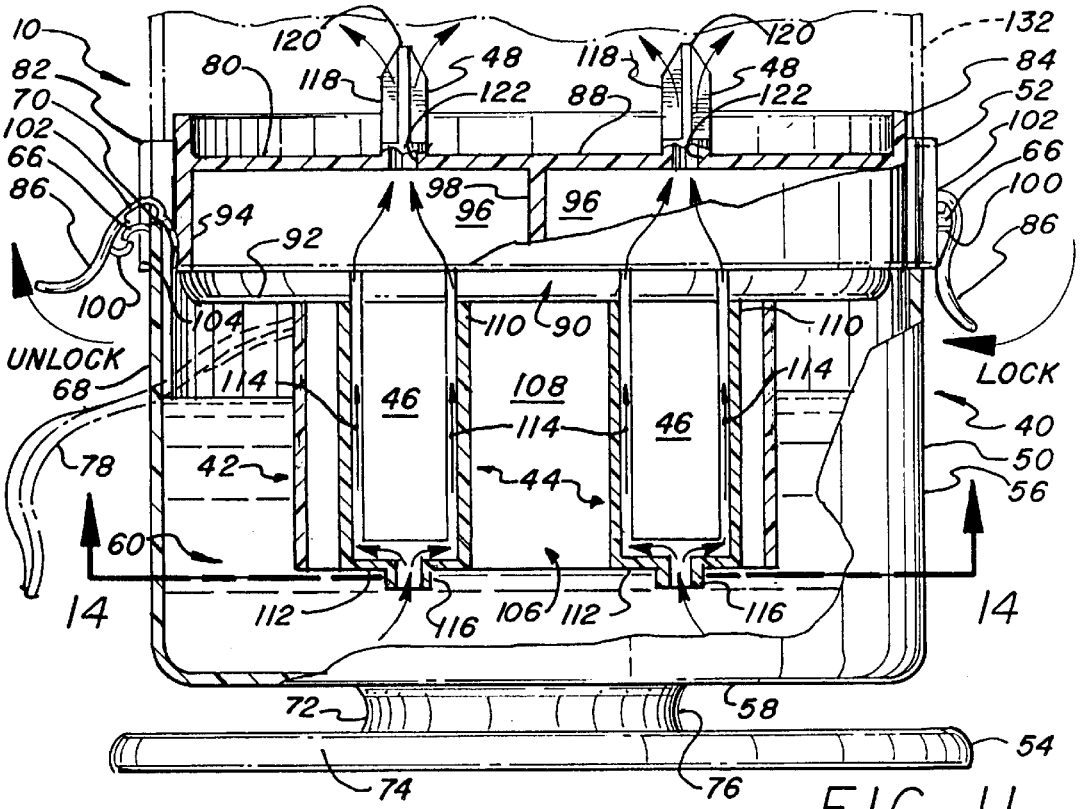
FIG. 11 is an enlarged fragmentary side elevational view of the apparatus of FIG. 10 with portions broken away and sectioned.

Referring to the drawings, and particularly to FIGS. 1 to 9, there is illustrated a multiple hair setting roller heating and facial steaming apparatus of the present invention, generally designated 10. The multiple hair setting roller heating and facial steaming apparatus 10 can be operated by an individual user as a multiple hair setting roller heating apparatus for heating hair setting rollers or as a facial steaming apparatus for serving as a facial sauna or steamer, a humidifier and/or a steamer with or without aromatherapy and with or without mineral water to provide for beauty treatment needs of the individual. The apparatus 10 may be provided separately as either a multiple hair setting roller heating apparatus or as a facial steaming apparatus or may be provided as a combination thereof as the multiple hair setting roller heating and facial steaming apparatus 10.

Figure 12:
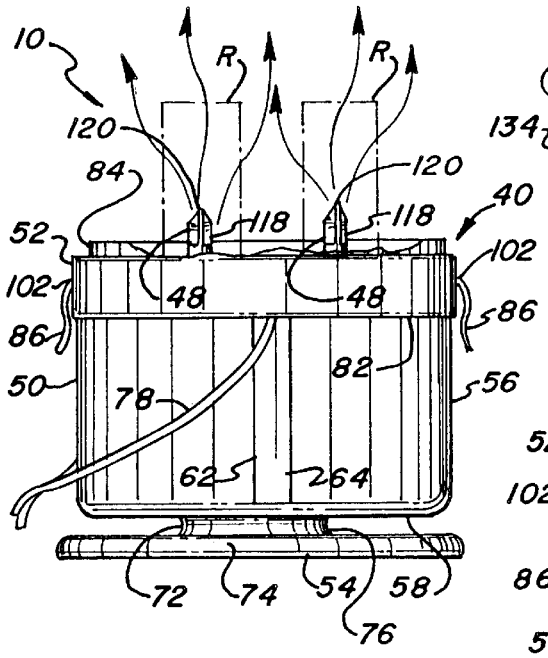
FIG. 12 is a side elevational view on a reduced scale of the apparatus of FIGS. 10 and 11 after conversion for use as a multiple hair setting roller heater.
Figure 13:
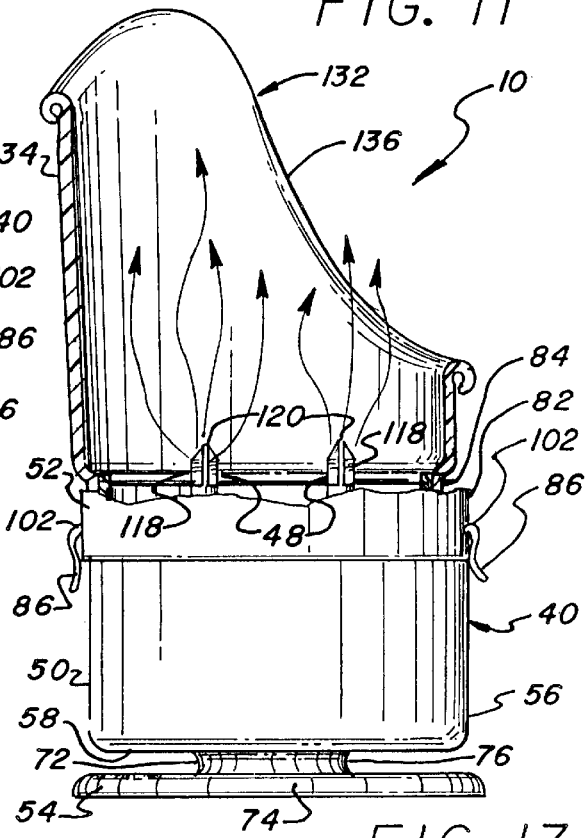
FIG. 13 is a side elevational on a reduced scale of the apparatus of FIGS. 10 and 11 after conversion for use as a facial sauna or steamer.

The multiple hair setting roller heating and facial steaming apparatus 10 basically-includes a heating device 12 and a hood 14. The hood 14 may be collapsible and/or flexible or, alternatively, relatively rigid. The hood 14 may be employed with the heating device 12 for heating hair setting rollers R (shown in phantom outline form in FIGS. 10 and 12) or steaming a face. The hood 14 is fitted onto the heating device 12 so as to provide a selected one of the several above-mentioned beauty treatments. The primary use for the apparatus 10 is heating hair setting rollers R. The secondary use for the apparatus 10 is as the steam source when used as the facial sauna or steamer (with or without mineral water or with or without aromatherapy) or used as a humidifier. The heating device 12 has a housing 16 which defines a receptacle 18 in a lower end thereof for holding a small quantity of a desired liquid, such as water alone and/or water with some other liquid which is scented. The heating device 12 also has a heating element 20 mounted to the housing 16 and disposed in the receptacle 18 to contact the liquid therein and to heat the liquid to a temperature at which it gives off vapors or produces steam. The heating device 12 further has an electrical cord 22 connected to the heating element 20 for supplying electrical power thereto. The housing 16 can be made of any suitable material, such as a suitable plastic, glass or metal. The heating element 20 and electrical cord 22 per se can be components well-known to those of ordinary skill in the art. The heating device 12 is also adapted to be used without a liquid present in the receptacle 18 for supplying a dry form of heat to simulate the effect of a sauna for a user.

The heating device 10 may also employ a platform 24 and a plurality of picks or studs 26. The platform 24 is generally flat and overlies the receptacle 18. The studs 26 are attached on the platform 24 and extend upright for supporting a plurality of hair rollers (not shown) in a vertical standing orientation. The studs 26 can be provided to extend to any desired height above the platform 24. The studs 26 are preferably hollow or have internal passages to permit passage through them of the heat, vapors or steam generated below by the heating element 20.

The hood 14 of the apparatus 10 preferably is a tubular body open at its opposite upper and lower ends 14A, 14B and is fabricated from a suitable material which can be flexible or substantially rigid. In either case, the material of the hood 14 preferably is sufficiently resilient as to be capable of maintaining a desired freestanding condition in which the upper open end 14A of the hood 14 will conform to the general shape of a woman's face and the lower open end 14B of the hood 14 will take on a cylindrical shape which will fit over a cylindrical top rim 28 of a side wall 30 of the housing 16. The material of the hood 14 may also be sufficiently flexible and have a memory so that it can readily be collapsed to a smaller volume to facilitate storage during periods when it is not in use and then when removed from storage the material retains sufficient memory to return and conform the hood 14 to its desired operative freestanding shape. One suitable material for the hood 14 is silicone. Other appropriate materials will be apparent to those of ordinary skill in the art. The hood 14 can be generally cylindrical in shape, having a substantially uniform length throughout, or the length can vary from place to place about the hood 14. Also, the hood 14 can have an irregular shape, such as outwardly flaring or other desired configurations. As depicted in FIG. 3, the upper open end 14A of the hood 14 can be inclined at an angle of from zero degrees to sixty degrees from the vertical and preferably at from fifteen degrees to forty-five degrees.

FIGS. 4 to 6 show different mating relationships between the lower open end 14B of the hood 14 and the top rim 28 of the housing 16 of the heating device 12. In FIG. 4 the lower open end 14B of the hood 14, being in the form of an annular bottom rim 32, is offset or stretched outwardly to fit over the top rim 28 of the housing 16. Alternatively, in FIG. 5 the bottom rim 32 of the hood 14 is offset inwardly to fit inside the top rim 28 of the housing 16. Alternatively again, in FIG. 6, the top rim 28 of the housing 16 can have a groove 34 into which the lower open end 14B of the hood 14 is inserted. Alternatively, the groove 34 can be made in the bottom rim 32 of the hood 14 to receive the top rim 28 of the housing 16. Thus, mating between the bottom rim 32 of the hood 14 and the top rim 28 of the housing 16 of the heating device 12 can be provided such that the hood 14 can fit on the inside, the outside and/or within the groove 34 on the top rim 28 of the housing 16. The bottom rim 32 of the hood 14 can be made of increased thickness compared to the rest of the hood 14 so as to provide additional structural integrity for mating with the housing 16 of the heating device 12. Furthermore, the upper end portion 14A of the hood 14 can be made of increased thickness and have a rounded upper edge surface for comfort relationship to the user's face.

FIGS. 7 to 9 depict an optional feature of the apparatus 10 in the form of an annular adapter 36 for providing an interface between the top rim 28 of the housing 16 of the heating device 12 and the bottom rim 32 of the hood 14 in cases where the hood 14 has a smaller size than the housing 16. As in the case of the bottom rim 32 of the hood 14 described above, the adapter 36 can be constructed to mate with the outside (FIG. 7) or the inside (FIG. 8) of the top rim 28 of the housing 16 of the heating device 12. The adapter 36 may also define a groove 38 (FIG. 9) for receiving the bottom rim 32 of the hood 14 and fitting inside the top rim 28 of the housing 16 of the heating device 12. Furthermore, the adapter 36 may frictionally fit with the housing top rim 28 or a threaded or twist lock type interfitting feature can be provided on the adapter 36 and top rim 28.

When the apparatus 10 is converted for use as the above-described facial sauna/steamer, women can now avoid having to make a spa appointment in advance and to wait hours, if not days, for a pore treatment. The apparatus 10 allows women to enjoy steaming facials anytime of the day or night. Also, a bit of scent can be added to the steaming facial water to permit the user to experience the immediate effects of sensory transformation.

Referring now to FIGS. 10 to 15, there is illustrated a preferred embodiment of the multiple hair setting roller heating and facial steaming apparatus 10. The multiple hair setting roller heating apparatus 10 basically includes a housing 40, an enclosure 42, a heating module 44, a heating element 46 and at least one and preferably a plurality of outlets 48. The housing 40 has a lower portion 50 and an upper portion 52. The lower portion 50 includes a lower base 54, an upper continuous side wall 56 and a bottom wall 58. The housing 40 can be made of any suitable material, such as a suitable plastic, glass or metal. The upper side wall 56 has a substantially cylindrical configuration. The upper side wall 56 and the bottom wall 58 together define a receptacle 60 for receiving and holding a quantity of a desired liquid, such as water alone, or water and/or some other liquid that is scented. The upper side wall 56 has an interiorly indented portion 62 which defines a vertical recess 64. The upper side wall 56 also has a pair of opposite first tabs 66 on an outer side 68 and adjacent to a top edge 70 of the upper side wall 56. The lower base 54 has a neck 72 and a base plate 74. The neck 72 is attached at an upper end to the bottom wall 58 and is attached at a lower end to the base plate 74. The neck 72 has a diameter substantially less than a diameter of the upper side wall 56 and defines a recessed region 76 surrounding the neck 72 and underlying the bottom wall 58. The base plate 74 contacts an external surface for resting the apparatus 10 thereon.

The apparatus 10 may further include an electrical cord 78 connected to the heating element 46 for supplying electrical power thereto. The heating element 46 and electrical cord 78 per se may be components well-known to those of ordinary skill in the art. The electrical cord 78 may be extended along vertical recess 64 in the upper side wall 56 and wrapped around the neck 72 and stored in the recessed region 76.

The upper portion 52 of the housing 40 is removably mounted on the lower portion 50 thereof and includes a platform 80, a lower continuous side wall 82, a top rim 84 and a pair of opposite securing flaps 86. The upper portion 52 of the housing 40 is temporarily removed from the lower portion 50 thereof to allow pouring a suitable liquid into the receptacle 60 of the lower portion 58. The platform 80 has an upper portion 88 and a lower portion 90 which are attached to one another. The upper portion 88 is substantially flat and round. The lower portion 90 is substantially in the shape of a dish with a bottom wall 92 and a continuous side wall 94. The side wall 94 has a substantially cylindrical configuration and extends upwardly from a periphery of the bottom wall 92. The lower portion 90 and upper portion 88 together define an upper passage 96. The upper passage 96 is preferably divided into a pair of compartments of equal size, or of any other suitable size in relation to one another, by a partition 98 extending vertically between and attached to the upper and lower portions 88 and 90. The lower side wall 82 has a substantially cylindrical configuration and extends downwardly from a periphery of the upper portion 88 of the platform 80. The lower side wall 82 has a diameter greater than a diameter of the side wall 94 for fitting the lower side wall 82 over the side wall 94. The diameter of the lower side wall 82 is also greater than the diameter of the upper side wall 56 of the lower portion 50 for fitting the lower side wall 82 over the upper side wall 56. The diameter of the upper side wall 56 is greater than that of the side wall 94 such that the upper side wall 56 fits between the lower side wall 82 and the side wall 94.

Each securing flap 86 has a second tab 100 mateable with a first tab 66 of the upper side wall 56 of the lower portion 50. Each securing flap 86 is mounted to the lower side wall 82 by a living hinge 102 and is movable between a locked condition where the second tab 100 is mated with the first tab 66 and an unlocked condition where the second tab 100 is released from the first tab 66. The lower side wall 82 defines a pair of opposite gaps 104. Each gap 104 is disposed below one of the living hinges 102 and permits passage of the second tab 100 therethrough for mating with the first tab 66. Alternatively, screw threads can be provided instead of the above-described locking features for releasably attaching the upper portion 52 upon the lower portion 50 of the housing 40.

The enclosure 42 has an open bottom 106 and defines an interior chamber 108. The enclosure 42 is in the form of a continuous side wall 42 which has a substantially rectangular configuration with round corners. The enclosure 42 is mounted to and extends downwardly from and at a central location of the bottom wall 92 of the lower portion 90 of the platform 80 of the upper portion 52 of the housing 40 and into the receptacle 60 of the lower portion 50 of the housing 40 below the surface of the quantity of liquid in the receptacle 60 such that air is captured in the interior chamber 108 so as to prevent entry of the liquid into the interior chamber 108.

The heating module 44 has an upper end 110 and a lower end 112 and is disposed in the interior chamber 108 of the enclosure 42. The heating module 44 is in the form of a rectangular box, though may have any other suitable shape. The heating module 44 at its upper end 110 is mounted to the bottom wall 92 of the lower portion 90 of the platform 80 of the upper portion 52 of the housing 40 and extends downwardly therefrom to its lower end 112. The heating module 44 further has a lower passage 114 and an inlet 116 defined in its lower end 112 extending below the open bottom 106 of the enclosure 42 so as to provide direct flow communication of liquid from the receptacle 60 of the lower portion 50 of the housing 40 to the lower passage 114 of the heating module 44 bypassing the interior chamber 108 of the enclosure 42. The lower passage 114 is in flow communication with the upper passage 96 of the platform 80 on one side of the partition 98 therein. The heating element 46 is mounted in the lower passage 114 of the heating module 44 and is operable to convert the liquid to vapor therein.

The apparatus 10 may further include a second heating module 44 spaced apart from the first heating module 44 and also having an upper end 110 and a lower end 112 and being disposed in the interior chamber 108 of the enclosure 42. The second heating module 44 is similarly mounted to the platform 80 and extends downwardly therefrom and likewise has a lower passage 114 and an inlet 116 extending below the open bottom 106 of the enclosure 42 providing direct flow communication of liquid from the receptacle 60 of the lower portion 50 of the housing 40 to the lower passage 114 of the heating module 44 bypassing the interior chamber 108 of the enclosure 42. The lower passage 114 of the second heating module 44 is also in flow communication with the upper passage 96 of the platform 80 but on the opposite side of the partition 98 therein.

A second heating element 46 is also mounted in the lower passage 114 of the second heating module 44 and is operable to convert the liquid to vapor therein. The lower passage 114 of each heating module 44 is in communication with one compartment of the upper passage 96 of the platform 80. The first and second heating elements 46 can be any suitable type. However, preferably the first and second heating elements 46 are each a type known as a positive temperature co-efficient (PTC) heater.

The outlets 48 preferably are formed on and extend above the upper portion 90 of the platform 80 of the upper portion 52 of the housing 40 so as to support the hair setting rollers R thereon and to provide flow communication of the vapor from the lower passage 114 of one of the heating modules 44 to above the platform 80 for heating the roller R with the vapor. The outlets 48 are preferably, but not necessarily, four in number and are substantially equally spaced apart from one another for supporting a plurality of hair setting rollers R. Two of the outlets 48 are disposed on each side of the partition 98. Each heating module 44 is in flow communication with only the two outlets 48 on the same side of the partition 98 as the heating module 44. The provision of at least two outlets 48 communicating with each of the PTC heaters 46 of the heating modules 44 at least doubles the productivity of each heating module 44. Each outlet 48 is in the form of a stud or pick having a body 118, preferably tubular in shape, and a pointed tip 120 which defines a plurality of vents 122 for passage of the vapor therethrough. Each pick 48 can extend to any desired height above the platform 80. The picks 48 are preferably hollow to permit passage through them of the heat, vapors or steam generated below by the heating element 46. The vents 122 are structured to provide for substantially even dispersion of steam above the platform 80. The top rim 84 of the upper portion 52 of the housing 40 is attached to and extends above the upper portion 88 of the platform 80 and surrounds the outer periphery of the platform 80 and the outlets 48 so as to provide an area for collection of liquid condensed from the vapor above the platform 80.

The apparatus 10 may further include a removable cover 124 mounted to the upper portion 52 of the housing 40 and disposed over the platform 80 of the upper portion 52 of the housing 40 so as to cover or enclose the outlets 48. The removable cover 124 has a top wall 126 and a continuous side wall 128. The side wall 128 has a substantially cylindrical configuration and a diameter slightly greater than a diameter of the top rim 84 of the upper portion 52 of the housing 40 and substantially similar to the diameter of the lower side wall 82 of the upper portion 52 of the housing 40 for fitting over the top rim 84 and for resting on top of the lower side wall 82. The removable cover 124 also has a knob 130 mounted to and at a center of the top wall 126 for gripping by a user. The knob 130 may have any desired shape and size.

The facial steaming apparatus 10 basically includes the housing 40, heating element 46, at least one outlet 48, each as described above in the multiple hair setting roller heating apparatus 10, and a hood 132 in the form of a tubular body having opposite upper and lower open ends 132A, 132B and a continuous side wall 134 defining an open portion 136 conforming to a chin and face of a woman. The lower open end 132B interfits with the upper portion 52 of the housing 40 and receives the source of steam. The hood 132 also has a continuous ledge 138 extending interiorly from the lower open end 132B of the hood 132. The heating element 46 is adapted to be used with or without liquid present in the receptacle 60 of the lower portion 50 of the housing 40. Without liquid present, the heating element 46 supplies a dry form of heat to simulate the effect of a sauna for the user. The apparatus 10 further includes the electrical cord 78 connected to the heating element 46. The apparatus 10 may also include the removable cover 124 which seats on the ledge 138 and is disposed over the platform 80 of the upper portion 52 of the housing 40 so as to enclose the at least one outlet 48. The side wall 134 of the hood 132 flares outwardly and is inclined generally at an angle of from zero to sixty degrees from a vertical and preferably at an angle of from fifteen to forty-five degrees from a vertical. The hood 132 is fabricated from a suitable material which can be flexible or substantially rigid. In either case, the material of the hood 132 preferably is sufficiently resilient as to be capable of maintaining a desired freestanding condition.

As mentioned above, the apparatus 10 may also embody a combination of the multiple hair setting roller heating apparatus 10 and facial steaming apparatus 10 in the form of the multiple hair setting roller heating and facial steaming apparatus 10. The multiple hair setting roller heating and facial steaming apparatus 10 includes all of the elements above described as part of the multiple hair setting roller heating apparatus 10 and facial steaming apparatus 10 in their separate embodiments. The multiple hair setting roller heating and facial steaming apparatus 10 is convertible from facial steaming use to hair roller heating use merely by removing the hood 132 from the housing 40 of the apparatus 10.

It is thought that the present invention and its advantages will be understood from the foregoing description and it will be apparent that various changes may be made thereto without departing from the spirit and scope of the invention or sacrificing all of its material advantages, the forms hereinbefore described being merely preferred or exemplary embodiments thereof.

I claim:

1. A multiple hair setting roller heating apparatus, comprising:

(a) a housing having a lower portion and an upper portion, said lower portion defining a receptacle for receiving and holding a quantity of a desired liquid, said upper portion defining a platform above said receptacle having an outer periphery;

(b) a heating module having an upper end and a lower end and being mounted in said housing below said platform thereof and extending downwardly into said receptacle thereof, said heating module further having a passage extending between said upper and lower ends thereof so as to provide flow communication of liquid from said receptacle of said housing to said platform thereof;

(c) a heating element mounted in said passage of said heating module and being operable to convert the liquid to vapor therein; and (d) at least two outlets extending from said platform of said upper portion of said housing, each of said outlets being adapted to support a hair setting roller and provide flow communication of the vapor from said passage of said heating module to above said platform of said housing for heating the hair setting rollers with the vapor;

(e) said upper portion of said housing also defining a top rim attached to and extending above said platform and surrounding said outer periphery of said platform and said outlets so as to provide an area for collection of liquid condensation from the vapor above said platform.

2. The apparatus of claim 1 wherein each of said outlets is a pick having a body adapted to support a hair setting roller and defining at least one vent for passage of the vapor therethrough.

3. The apparatus of claim 2 wherein said body of said pick is tubular in shape.

4. An apparatus convertible between multiple hair setting roller heating and facial steaming uses, said apparatus comprising:

(a) a housing having a lower portion and an upper portion, said lower portion defining a receptacle for receiving and holding a quantity of a desired liquid, said upper portion being mounted on said lower portion and defining a platform having an outer periphery;

(b) a heating mechanism mounted in said housing and extending downwardly from said platform into said receptacle and being operable to convert the liquid to vapor;

(c) at least one outlet extending from said platform of said upper portion of said housing and adapted to support a hair setting roller above said platform, said outlet defining at least one vent for passage of the vapor therethrough so as to provide flow communication of the vapor from below said platform for use as a source of steam above said platform, said upper portion of said housing also defining a top rim attached to and extending above said platform and surrounding said outer periphery of said platform and said outlet so as to provide an area for collection of liquid condensation from the vapor above said platform; and (d) a hood in the form of a tubular body having opposite upper and lower open ends and a continuous side wall defining an open portion conforming to a chin and face of a woman, said lower open end interfitting with said upper portion of said housing and receiving the source of steam.

5. The apparatus of claim 4 wherein said lower open end of said hood has a bottom rim and said upper portion of said housing has a top rim for interfitting with said bottom rim of said lower open end of said hood for removably securing said hood on said upper portion of said housing.

6. The apparatus of claim 4 wherein said outlet is a pick having a body adapted to support a hair setting roller and defining said at least one vent for passage of the vapor therethrough.

7. The apparatus of claim 6 wherein said body of said pick is tubular in shape.

8. A hair setting roller heating and facial steaming apparatus, comprising:

(a) a housing having a lower portion and an upper portion, said lower portion defining a receptacle for receiving and holding a quantity of a desired liquid, said upper portion being mounted on said lower portion and defining a platform having an outer periphery;

(b) a heating mechanism mounted in said housing and extending downwardly from said platform into said receptacle and being operable to convert the liquid to vapor;

(c) at least one outlet extending from said platform of said upper portion of said housing and adapted to support a hair setting roller above said platform, said outlet defining at least one vent for passage of the vapor therethrough so as to provide flow communication of the vapor from below said platform for use as a source of steam above said platform, said upper portion of said housing also defining a top rim attached to and extending above said platform and surrounding said outer periphery of said platform and said at least one outlet so as to provide an area for collection of liquid condensation from the vapor above said platform; and (d) a hood in the form of a tubular body having opposite upper and lower open ends and a continuous side wall defining an open portion conforming to a chin and face of a woman, said lower open end having a bottom rim for interfitting with said top rim of said upper portion of said housing for removably securing said hood on said upper portion of said housing and for receiving the source of steam.

9. The apparatus of claim 8 wherein said outlet is a pick having a body adapted to support a hair setting roller and defining said at least one vent for passage of the vapor therethrough.

10. The apparatus of claim 9 wherein said body of said pick is tubular in shape.

* * * * *